US006076690A

United States Patent [19]

Hemmerly

[11] Patent Number: 6,076,690

[45] Date of Patent: Jun. 20, 2000

[54] FASTENER FREE CONTAINER

[75] Inventor: Todd S. Hemmerly, Upper Sandusky, Ohio

[73] Assignee: Concept Packaging Group, Inman, S.C.

[21] Appl. No.: 09/260,798

[22] Filed: Mar. 1, 1999

Related U.S. Application Data

[60] Provisional application No. 60/104,050, Oct. 13, 1998.

[51] Int. Cl.[7] ..... B65D 6/24

[52] U.S. Cl. ..... 217/43 R; 217/65; 206/600; 220/4.28

[58] Field of Search ..... 217/43 R, 43 A, 217/45, 65, 12 R; 206/600, 386; 220/4.28, 4.29, 4.31, 4.33, 4.34

[56] References Cited

U.S. PATENT DOCUMENTS

| | | | |
|---|---|---|---|
| 1,705,003 | 3/1929 | Crosley . | |
| 1,737,186 | 11/1929 | Champlin . | |
| 1,931,461 | 10/1933 | MacKenzie | 217/43 R |
| 2,738,058 | 3/1956 | Hansen et al. | 217/43 A |
| 3,080,992 | 3/1963 | Dedmon | 217/43 A |
| 3,705,663 | 12/1972 | Schubert et al. | 217/12 R |
| 4,171,741 | 10/1979 | Fish | 206/335 |
| 4,230,227 | 10/1980 | Kowall et al. | 206/600 |
| 4,832,256 | 5/1989 | Grigsby | 229/23 C |
| 5,269,455 | 12/1993 | Grigsby et al. | 229/23 |
| 5,289,933 | 3/1994 | Streich et al. | 220/1.5 |
| 5,441,154 | 8/1995 | Youell, III | 206/599 |
| 5,560,508 | 10/1996 | Hsu | 220/4.31 |
| 5,609,111 | 3/1997 | Hasegawa et al. | 108/55.1 |
| 5,622,306 | 4/1997 | Grigsby, Sr. | 229/23 |
| 5,669,507 | 9/1997 | Pruitt, Jr. | 206/600 |
| 5,725,118 | 3/1998 | Slager et al. | 220/4.28 |
| 5,743,421 | 4/1998 | Gonzalez et al. | 220/4.28 |
| 5,772,026 | 6/1998 | Grigsby | 206/335 |
| 5,799,812 | 9/1998 | Mansouri et al. | 220/4.31 |

FOREIGN PATENT DOCUMENTS

| | | | |
|---|---|---|---|
| 78763 | 3/1955 | Netherlands | 217/43 A |
| 1392808 | 4/1975 | United Kingdom | 217/43 R |

*Primary Examiner*—Stephen Castellano

*Attorney, Agent, or Firm*—Van Dyke, Gardner, Linn & Burkhart, LLP

[57] ABSTRACT

A container includes a palletized base for which at least four side walls can be releasably secured without the use of separate fasteners. A cover can also be releasably secured to the four side walls without the use of separate fasteners. The releasable securing of the container components is accomplished by a series of dowel holes defined in the base and cover. Corresponding dowel pins fit into the dowel holes for secure attachment that permits easy disassembly and reassembly.

19 Claims, 4 Drawing Sheets

FASTENER FREE CONTAINER

This application claims priority to United States Provisional Application Ser. No. 60/104,050, filed Oct. 13, 1998, entitled Fastener Free Container.

BACKGROUND OF THE INVENTION

The present invention relates generally to containers for storing and transporting goods, and in particular to palletized containers used for storing and shipping relatively large goods.

The packaging and shipping of larger items, such as lawn tractors, refrigerators, or the like, can be quite costly and labor intensive. Such large items are usually packaged and shipped on containers that are constructed on top of a pallet, thereby allowing them to be lifted by a forklift truck, or the like. Due to the size of the items being packaged and shipped, they are customarily placed on the pallet prior to the container being completely assembled. Once on the pallet, the container is usually constructed around the item, and thereby secures the item in the container. The containers may be constructed to allow themselves to be stacked on top of each other after they are constructed and filled with the desired items.

In the past, the construction of the containers has been a fairly time consuming, labor intensive, and expensive task. The construction of the container typically required the use of fasteners to secure the parts of the containers together. The fasteners, such as nails, screws, or the like, add an expense to the price of the container. Moreover, the use of these fasteners requires not only the alignment of the container parts, but the subsequent insertion of the fastener into the parts to be secured together. The use of fasteners also renders the disassembly of the container more time consuming and expensive, and further may diminish the ability of the container to be reused. While nails and screws can be used to reassemble the container multiple times, eventually the recurrent nailing or screwing of the container components in the same places will cause the parts to wear out. Replacement of the worn out parts is a further disadvantage of prior art containers. The time, effort, and financial expense of constructing, using, and reusing prior palletized containers has created the desire for containers that are easier to construct and deconstruct and that are less expensive.

SUMMARY OF THE INVENTION

Accordingly, the present invention provides a container that can be easily constructed and disassembled in a reduced amount of time. The container does not require any separate fasteners to be used during its construction and it can be repeatedly reused without the need to replace its component parts.

A container according to one aspect of the present invention includes a pallet on top of which two baseboards or rails are fixedly attached. The two rails each have first and second ends and define a pair of dowel holes adjacent each of the first and second ends. The containers also includes four wall members having posts defined at each end of each of the wall members. Each of the posts have a top and bottom dowel. The bottom dowel is dimensioned to snugly fit into one of the dowel holes defined in the rails. Insertion of the bottom dowels into the dowel holes defined on the rails creates a four walled container that can be constructed by an end user without the use of separate fasteners. In like fashion, the preformed top or cover of the container includes selected dowel holes which are aligned with the top dowels of the container side walls when placed on top of the container. The snug, facile, and firm fit of the container components creates a stable, fully enclosed container. The lack of fasteners decreases assembly time, reduces parts and shipping costs, allows easy disassembly, and enables the container to be repeatedly reused.

In yet another aspect, the side walls may be provided with a center post having a top dowel and the cover may include aligned openings for accommodating the upper dowels of the center post to thereby provide further stability to the fully erected container.

DESCRIPTION OF THE PREFERRED EMBODIMENT

Figure 1:
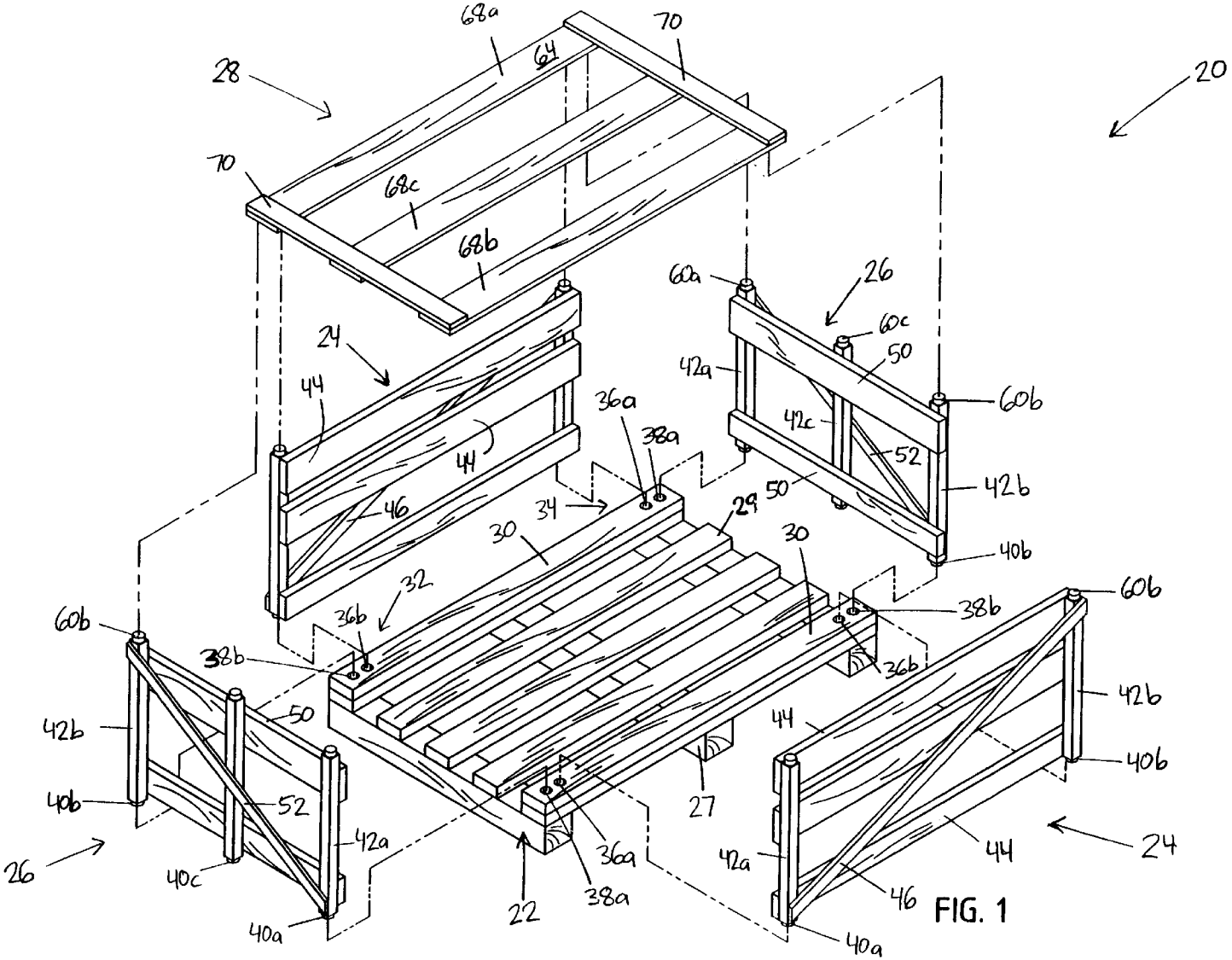
FIG. 1 is a perspective, exploded view of a container according to one aspect of the present invention.

The present invention will now be described with reference to the accompanying drawings wherein like reference numerals corresponds to like elements in the several drawings. A container 20 according to one aspect of the present invention is depicted in FIG. 1 in exploded view. Container 20 includes six basic parts that are shipped to an end user in unassembled form. The six parts include a pallet 22, two long side walls 24, two short side walls 26, and a cover 28. Container 20 is typically assembled after an item has been placed on pallet 22. The item is typically, though not necessarily, a large item, such as a riding lawnmower, a plurality of automobile windshields, a refrigerator, or other appliance. In some cases, the pallet may have additional prefabricated parts to accommodate or receive the item or items in a preferred orientation. Typically, the end user is the manufacturer of the item being packaged for shipment. Once assembled, container 20 and its contents can be securely moved via a forklift truck or other means.

As can be seen in FIG. 1, container 20 is generally assembled by inserting dowels on the side walls into dowel holes defined in the pallet and cover, as will be more fully explained below. The design of container 20 allows the user to assemble the six parts into the container without the need for separate fasteners, such as nails or the like.

Figure 2:
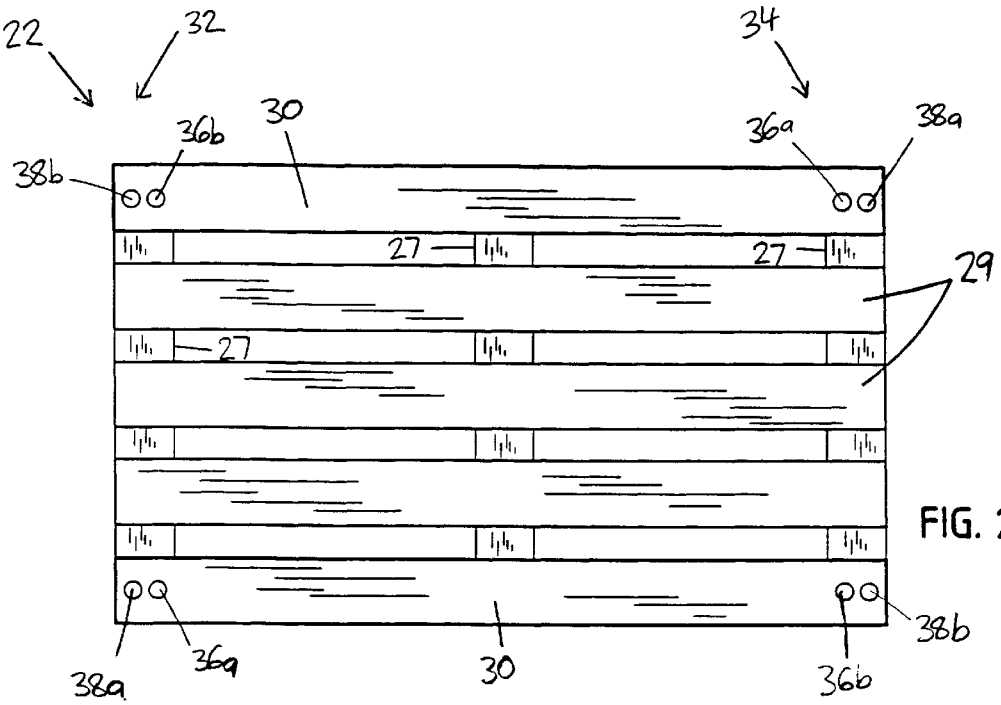
FIG. 2 is a plan view of a pallet.
Figure 3:
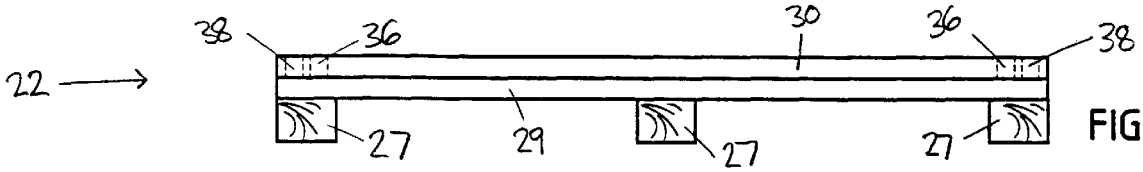
FIG. 3 is a side, elevational view of the pallet of FIG. 2.

Pallet 22 can be any standard pallet on top of which a pair of rails 30 are fixedly attached. In the illustrated embodiment, pallet 22 includes three spaced and parallel baseboards 27 that are secured together via a series of overlying transverse beams 29 (FIGS. 1–3). Rails 30 are arranged parallel to each other and are fixed to pallet 22 on opposite sides of the pallet. While the rails 30 are depicted in FIGS. 1–3 as being arranged along sides that are parallel to transverse beams 29 of pallet 22, rails 30 could be oriented perpendicular to transverse beams 29, depending on which type of pallet is used. In one embodiment, rails 30 are 2×4's, although it will be understood by one skilled in the art that other sized boards can be used. Each rail 30 includes a first end 32 and a second end 34. An inner dowel hole 36 and an outer dowel hole 38 are defined on the top surface of rails 30 at each end (see FIGS. 1–3 and 6). While it is of course possible to used different dimension for inner and outer dowel holes 36 and 38, the depth of inner and outer dowel holes 36 and 38 is 1½ inches in the current embodiment. The diameter of each of these circular dowel holes 36 and 38 is also 1½ inches. The distance between inner dowel hole 36 and outer dowel hole 38 is approximately ⅝ of an inch. Inner dowel holes 36 are defined in rails 30 at locations where they will receive lower dowels 40 on long side walls 24.

Figure 4:
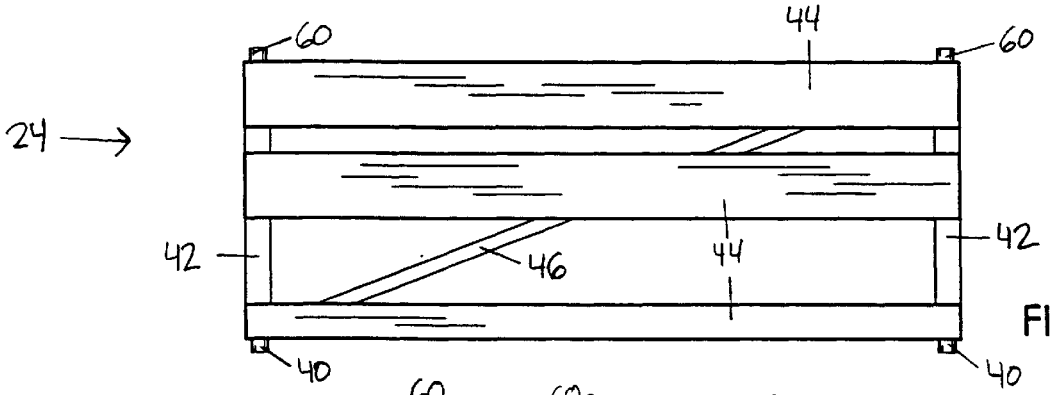
FIG. 4 is a side, elevational view of a long side wall.

Long side walls 24 include a pair of vertical posts 42*a* and *b* disposed at opposite ends of long side walls 24 (FIGS. 1 and 4). Vertical posts 42*a* and *b* are attached to each other by three cross beams 44*a, b* and *c*. The number, size, and shape of cross beams 44 can be varied as desired for the particular contents of container 20. In the current embodiment, cross beams 44 are attached to vertical posts 42 on an inside surface of posts 42, i.e. the surface facing the items inside the assembled container. If desired, of course, cross beams 44 could be attached to the outside surface of posts 42. A diagonal beam 46 is attached, in the current embodiment, to the outside surface of posts 42. The attachment of beams 44 and 46 to posts 42 can be accomplished by any suitable fasteners, such as nails, screws, glue or others.

Figure 5:
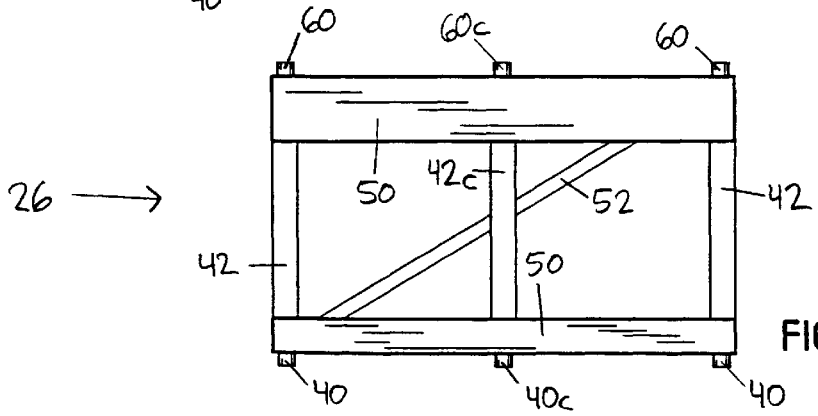
FIG. 5 is a side, elevational view of a short side wall.
Figure 6:
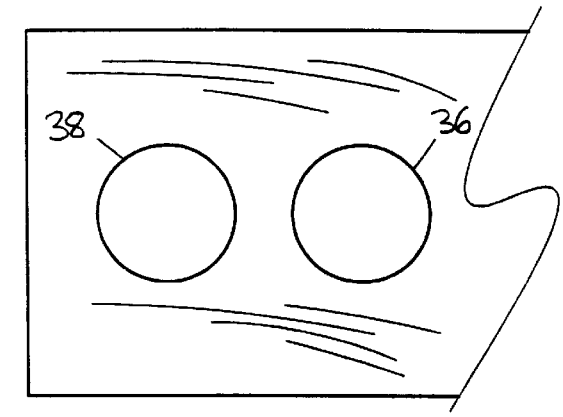
FIG. 6 is a fragmentary, plan view of one end of a rail.

Short side walls 26 include two outer vertical posts 42*a* and *b* and a center post 42*c* that are all secured together by upper and lower cross beams 50*a* and 50*b* (FIGS. 1 and 5). Cross beams 50*a* and *b* are attached to the inside of posts 42*a, b*, and *c*. A diagonal beam 52 is attached to the outside surface of posts 42*a, b*, and *c*. The number, size, and shape of cross beams 50*a* and *b*, can be varied according to the desired application. The attachment of beams 50 and 52 to posts 42*a–c* can also be accomplished by any suitable fasteners, such as nails, screws, glue, or the like.

Figure 7:
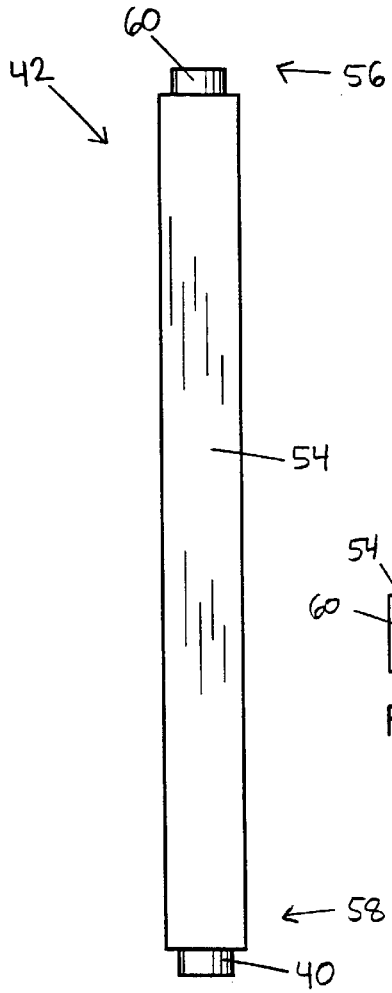
FIG. 7 is an elevational view of a post.
Figure 8:
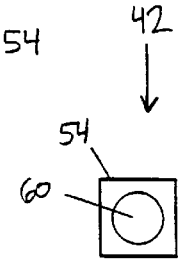
FIG. 8 is a plan view of the post of FIG. 7.

Posts 42*a, b*, and *c* are identical except for their location on short side walls 26. Posts 42 include a square, center beam 54 having a top end 56 and bottom end 58 (FIGS. 7–8). A lower dowel 40 is defined at bottom end 58 of posts 42 and upper dowel 60 is defined at top end 56 of posts 42. As can be seen in FIG. 8, lower and upper dowels 40 and 60 are circular in cross section and are dimensioned to snugly fit into dowel holes 36*a* and *b* and 38*a* and *b* defined on rails 30. To assemble container 20, the lower dowels 40*a* and *b* on short side walls 26 are inserted into outer dowel holes 36*a* and *b*, respectively, defined in rails 30. Lower dowels 40*a* and *b* on long side walls 24 are inserted into inner dowel holes 36*a* and *b*, respectively, defined on rails 30. In the current embodiment, the length of all of the dowels is 1½ inches. By the use of dowel holes on rails 30 and dowels on long and short side walls 24 and 26, container 20 can be assembled and disassembled without the use of glue or other types of fasteners.

Figure 9:
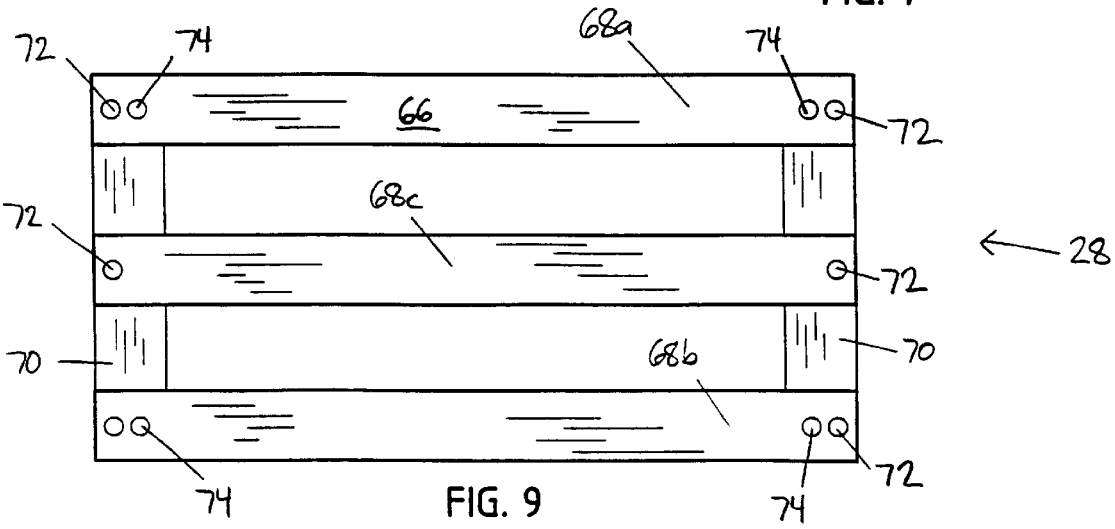
FIG. 9 is a plan view of the underside of one embodiment of a cover.
Figure 10:
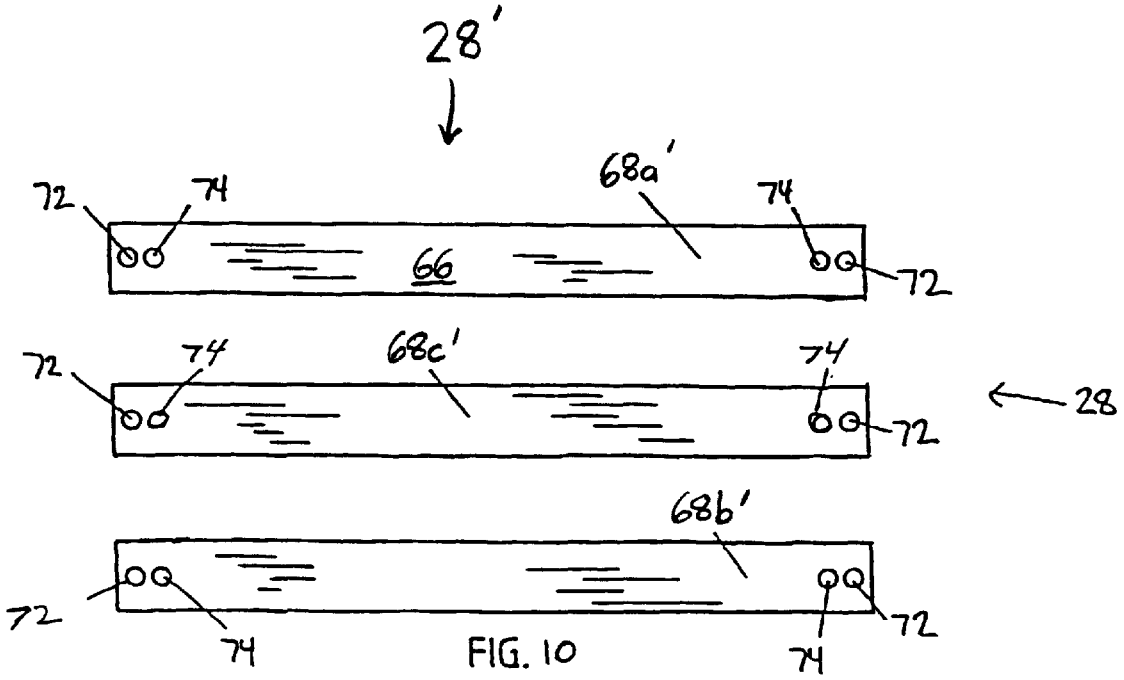
FIG. 10 is a plan view of the underside of a second embodiment of the cover.

Container 20 further includes a cover 28 having a top side 64 and an underside 66 (FIG. 9). Cover 28 includes three parallel, longitudinal beams 68*a, b*, and *c* which are fastened together at their ends by a pair of end beams 70. As shown in FIG. 9, center longitudinal beam 68*c* includes a single, outer dowel hole 72 defined at each of its ends on underside 66. Longitudinal beams 68*a* and 68*b* each include one outer dowel hole 72 and one inner dowel hole 74 defined at their ends on the underside 66 of cover 28. The dowel holes 72 and 74 defined in longitudinal beams 68*a* and 68*b* are located at a position to receive upper dowels 60 of long and short side walls 24 and 26. Dowel holes 72 defined in underside 66 of center longitudinal beam 68*c* receive the upper dowel pins of the center posts 42*c* of short side walls 26. A second embodiment of a cover 28' is depicted in FIG. 10. In this embodiment, beams 68*a–c'* are not connected together, but rather are separated. Cover 28' is currently the preferred cover for container 28. In either embodiment, beams 68*a–c* are preferably the same size and shape as rails 30, although other suitable shapes and sizes can of course be used.

When completely assembled, container 20 has been found in the current embodiment to have a top to bottom compression strength of over 12,000 lbs. Such a compression strength allows multiple stacking of the containers on top of each other. In the current embodiment, container 20 is preferably made of wood, and in particular, yellow pine, or spruce. It will understood by those skilled in the art that other varieties of wood can be used. Furthermore, other materials besides wood can also be used, such as metal or plastic.

Modifications from the embodiment disclosed in the accompanying drawings are also contemplated. For example, the number and/or shape of cross beams 44 and 50 connected between the vertical posts 42 can be varied to any practical configuration. If desired, the cross beams could simply comprise a single sheet of wood forming a solid wall. Alternately, cardboard could be attached to the cross beams to provide a completely enclosed container. As another example, additional vertical posts could be added to the long side walls for additional stability. The center post in the short side walls could also be removed, and the location of dowel holes and dowel pins could also be reversed, if desired.

While the present invention has been described in terms of the preferred embodiment discussed in the above specification, it will be understood by one skilled in the art that the present invention is not limited to these particular preferred embodiments, but includes any and all such modifications that are within the spirit and scope of the present invention as defined in the appended claims.

The embodiments of the present invention in which an exclusive property or privilege is claimed are defined as follows:

1. A container, comprising:

a pallet having a top and a bottom;

at least two rails attached to said top of said pallet, each of said rails having a first and a second end, each of said rails defining an inner and an outer dowel hole adjacent each of said first and second ends; and at least four wall members, each of said wall members further including a post defined at each end of said wall members, said posts having a top and a bottom dowel, said bottom dowel dimensioned to snugly engage at least one of said dowel holes defined in said rails;

whereby insertion of said bottom dowels of said wall members into said dowel holes defined on said rails creates a container that can be constructed by a user without the use of separate fasteners.

2. The container of claim 1 wherein said dowels and said dowel holes are all round.

3. The container of claim 1 further including at least two top beams, said top beams defining dowel holes adapted to receive said top dowels on said posts.

4. The container of claim 3 wherein at least two of said wall members further include a center post having a top dowel, and said container includes a center top beam having dowel holes defined to receive said top dowels on said intermediate posts.

5. The container of claim 2 further including at least two top beams, said top beams defining dowel holes adapted to receive said top dowels on said posts.

6. A container, comprising:

a pallet having four corners, a top and a bottom side said pallet including holes defined in said top side;

at least four pairs of posts adapted to be releasably secured to said top side of said pallet said posts each including dowels which are releasably inserted into said holes defined in the top side of said pallet, each said dowel being made of wood and each said hole being defined directly in said top side of said pallet;

at least four side members fixedly attached between each of said pairs of posts; and a top structure releasably secured to each of said four pairs of posts.

7. The container of claim 6 wherein said top structure is releasably secured to said four pairs of posts by dowel and dowel hole joints.

8. The container of claim 6 wherein said top side of said pallet includes at least eight holes and each of said pairs of posts includes at least two dowels dimensioned to be inserted in said holes.

9. The container of claim 7 wherein said four pairs of posts are releasably secured to said top side of said pallet by dowel and dowel hole joints.

10. A container, comprising:

a pallet having at least four sides;

at least four walls having a top and bottom end, said at least four walls adapted to be releasably attachable to said pallet such that the walls define a compartment when attached to said pallet, said walls adapted to be releasably secured to said pallet without the use of separate fasteners, each of said four walls defining at least two dowel pins at the top end of said walls; and a cover which releasably fits over the top end of said four walls, said cover defining sufficient dowel holes to receive at least two dowel pins from each of said walls.

11. The container of claim 10 wherein each of said at least four walls further define at least one dowel pin at the bottom end of said walls which fit into dowel holes defined on said pallet.

12. The container of claim 11 wherein said dowel holes defined on said pallet are defined on a plurality of rails secured to said pallet.

13. A container, comprising:

a base having a least four sides;

a plurality of rails secured to said base which define a plurality of dowel holes;

at least four walls having a top and bottom end, said at least four walls adapted to be releasably attachable to said base such that the walls define a compartment when attached to said base, said walls adapted to be releasably secured to said base without the use of separate fasteners, each of said four walls defining at least one dowel pin at the top end of said walls each of said at least four walls further including at least one dowel pin at the bottom of said walls which fit into said dowel holes defined on said base;

a cover which releasably fits over the top end of said four walls said cover defining sufficient dowel holes to receive at least one dowel pin from each of said walls; and each of said rails including a pair of dowel holes defined adjacent each end of said walls which are dimensioned to receive said dowel pins defined on the bottom end of said at least four walls.

14. The container of claim 13 wherein said dowel pins form a snug fit when positioned in said dowel holes.

15. The container of claim 13 wherein said dowel pins and dowel holes are generally cylindrical in shape.

16. The container of claim 12 wherein said cover includes at least two separated rails arranged generally parallel to each other when attached to said four walls.

17. The container of claim 12 wherein said cover includes a pair of rails arranged generally parallel to each other when attached to said four walls, each one of said pair of rails defining sufficient dowel holes to receive dowel pins from at least three of said walls.

18. The container of claim 16 wherein said cover further includes at least a third rail, said third rail positioned between said at least two rails and oriented generally parallel thereto.

19. The container of claim 18 wherein said at least two rails and said third rail are all fixedly attached to each other.

* * * * *